United States Patent [19]

Seto

[11] 4,402,599

[45] Sep. 6, 1983

[54] SCANNING SURFACE CLEANING METHOD OF ELECTROSTATIC RECORDING APPARATUS

[75] Inventor: Yutaka Seto, Hachioji, Japan

[73] Assignee: Konishiroku Photo Industry Co., Ltd., Tokyo, Japan

[21] Appl. No.: 242,689

[22] Filed: Mar. 11, 1981

[30] Foreign Application Priority Data

Mar. 17, 1980 [JP] Japan ..... 55-33715

[51] Int. Cl.[3] ..... G03G 13/22; G03G 21/00

[52] U.S. Cl. ..... 355/77; 15/256.51; 355/1; 355/15

[58] Field of Search ..... 355/1, 3 R, 15, 77; 15/1.5 R, 256.51, 256.52; 430/125

[56] References Cited

U.S. PATENT DOCUMENTS

| | | | |
|---|---|---|---|
| 3,706,491 | 12/1972 | Furman et al. | 15/1.5 R X |
| 3,961,848 | 6/1976 | Turner | 355/15 X |
| 4,025,181 | 5/1977 | Menon et al. | 355/15 X |
| 4,277,160 | 7/1981 | Yamada | 355/1 X |

*Primary Examiner*—Fred L. Braun

*Attorney, Agent, or Firm*—James E. Nilles

[57] ABSTRACT

In a method of cleaning the scanning surface of an electrostatic recording apparatus, the steps of: rendering inoperative a portion of an attachment device, which is used to treat the picture image forming member, when a cleaning operation is necessary; and electrostatically attaching a flexible cleaning sheet to the picture image forming member so that the cleaning sheet is carried past the reproducer scanning surface thereby to clean the scanning surface. The cleaning sheet is supplied from a recording paper supply magazine or from a magazine which is disposed above a recording paper supply magazine and discharged into a tray.

10 Claims, 6 Drawing Figures

SCANNING SURFACE CLEANING METHOD OF ELECTROSTATIC RECORDING APPARATUS

BACKGROUND OF THE INVENTION

1. Field of the Invention:

The present invention relates to an electrostatic recording apparatus of the type, in which a picture image forming member is scanned by reproducing means with an electric information signal fed so that the resultant electrostatic latent image upon said picture image forming member is developed with toner, and more particularly to a method for cleaning the scanning surface of the reproducing means, which has been blotted with the toner.

The term "reproducing means" appearing in the present specification is used to mean electro-optical converting means for scanning and reproducing an internal or external input information signal, which is fed as an off-line or on-line signal, upon a picture image forming member such as a photosensitive element or a dielectric element, for example, means having an optical fiber tube (OFT), a thin-window recording tube (TWT) or a fine needle-shaped electrode arranged so that a dielectric drum is scanned to reproduce an electrostatic image by the use of a change-over switch or a logic element such a a transistor or a field effect transistor.

2. Description of the Prior Art:

In an electrostatic recording apparatus of the type thus far described, generally speaking, the reproducing means such as the optical fiber tube is arranged to face the surface of picture image forming member (which will be called "a photosensitive member" hereinafter) such as a photosensitive drum so that an electrostatic latent image is formed on the surface of the photosensitive member and is developed with toner thereby to produce a visualized record.

Here, in such electrostatic recording apparatus, the floating toner is gradually caught by and piled upon the scanning surface of the reproducing means, as the recording apparatus proceeds, so that the effective brightness is lowered to deteriorate the contrast of the record (or the picture image) produced. It therefore becomes necessary to clean the scanning surface of the reproducing means at regular or irregular intervals. For this necessity, there has been made according to the prior art a trial, in which the scanning surface of the reproducing means is cleaned by forcing a soft wiping member of sheet shape between the surface of the photosensitive member and the scanning surface of the reproducing means. However, since the clearance between the surface of the photosensitive member and the scanning surface of the reproducing means is about 50 to 500 $\mu$m, the photosensitive member has its surface scratched, if the wiping member is forced to move, so that the expensive, photosensitive member is prematually aged. According to another device, on the other hand, the reproducing means is carried by a supporting structure, which is so constructed as to be removed, if necessary, from the photosensitive member, so that the toner remaining on the scanning surface is wiped off after the reproducing means has been removed from the photosensitive member. But such a device has drawbacks that a great effort is needed to keep the clearance between the surface of the reproducing means and the surface of the photosensitive member constant with an accuracy. No matter which method may be employed for cleaning the scanning surface according to the prior art, there arises a problem that a larger-sized supporting structure or means for driving the wiping member is required for the cleaning operation.

SUMMARY OF THE INVENTION

With a view to solve the aforementioned difficulty in the cleaning operation of a scanning surface, therefore, it is an object of the present invention to propose a scanning surface cleaning method of the type, in which a control circuit is switched with no or little change in an electrostatic recording apparatus thereby to interchange a series of operation sequences from a copying mode to a cleaning mode so that the scanning surface can be cleaned without hurting a photosensitive member. The scanning surface cleaning method according to the present invention is characterized by the steps of rendering at least a portion of an attachment device such as a developing device, a transfer electrode or a cleaner inoperative in the cleaning mode, and electrostatically attaching a cleaning sheet to the photosensitive member so that the cleaning sheet may pass over the scanning surface of the reproducing means.

The present invention will not be described in detail in connection with the embodiments thereof with reference to the accompanying drawings.

DESCRIPTION OF THE PREFERRED EMBODIMENTS

Figure 1:
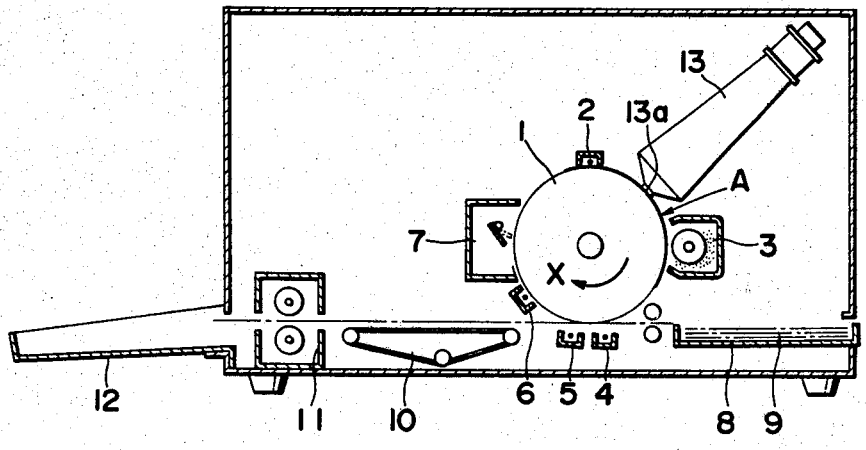
FIG. 1 is a sectional view showing an electrostatic recording apparatus, to which the present invention is applied.
Figure 2:
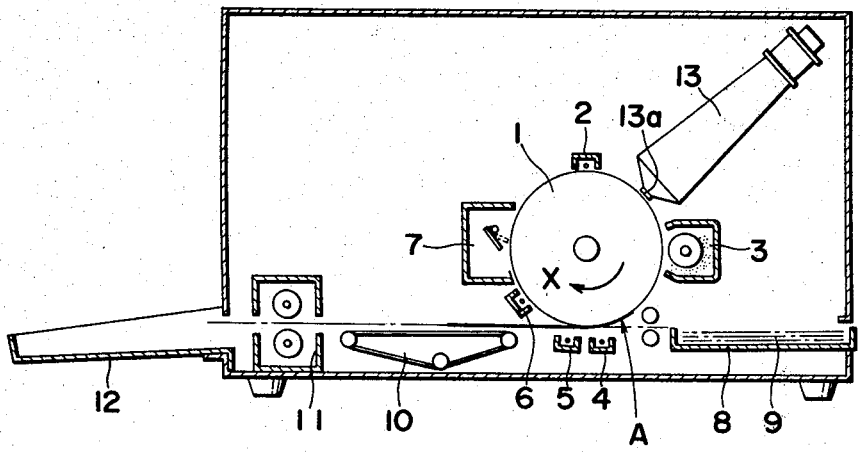
FIG. 2 is a similar sectional view for explaining the operation of the electrostatic recording apparatus of FIG. 1.

FIGS. 1 and 2 show a first embodiment of the present invention. In these Figures, around a photosensitive drum 1 having its surface made of a photoconductive material such as Se or ZnO, there are arranged a corona charger 2, a developing device 3, a transfer electrode 4, a separation electrode 5, a charge remover 6 and a cleaner 7, all of which take consecutively adjacent positions in the rotational direction X of the photosensitive drum 1. Thus, a sheet of recording paper 9 supplied from a magazine 8 passes through the clearance between the photosensitive drum 1 and the transfer electrode 4 so that it has a toner image transferred thereto during its passage until it is discharged through a conveyor 10 and a fixer 11 into a discharged paper tray 12. The electrostatic recording apparatus to which the present invention is applied is equipped with reproducing means 13, i.e., an optical fiber tube (OFT) which is interposed between the aforementioned corona charger 2 and the aforementioned developing device 3. That reproducing means 13 is formed with a scanning surface 13*a*, which is arranged to face the circumference of the aforementioned photosensitive drum 1, so that an electrostatic latent image is formed on the circumference of the photosensitive drum 1 by the action of the scanning beam which is synchronized with the rotational motion of the aforementioned photosensitive drum 1.

According to the present invention, in case the scanning surface 13*a* of the reproducing means 13 is to be cleaned, the electrostatic recording apparatus has its mode interchanged to a cleaning one, and the developing device 3, the transfer electrode 4, the separation electrode 5, the charge remover 6 and the cleaner 7 are held inoperative. Moreover, when the photosensitive drum 1 starts its rotation, the photosensitive drum 1 has its circumference charged by the corona charger 2, and a cleaning sheet A is supplied onto the circumference of the photosensitive drum 1 from the magazine 8 by making use of the delivery mechanism of the recording paper. That cleaning sheet A may be constructed of soft paper or cloth having a thickness of about 0.1 to 0.2 mm. The cleaning sheet A to be used is so made to have its surface roughed or implanted with hairs to have an electrically insulating property or its surface made irregular with fine folds or corrugations that the cleaning sheet A may be attracted to the circumference of the photosensitive drum 1 thereby to wipe the residual toner out of the scanning surface 13*a*.

As a result, in accordance with the rotation of the photosensitive drum 1, the cleaning sheet A attracted thereby moves past the scanning surface of the reproducing means 13, as shown in FIG. 1. Since, during this passage, the cleaning sheet A wipes off the scanning surface 13*a*, this scanning surface 13*a* has its toner wiped off so that it is cleaned. After that, when the cleaning sheet A comes to face the separation electrode 5, it is separated from the photosensitive drum 1 by the action of that separation electrode 5 so that it is discharged into the tray 12 by the conveyor means 10, as shown in FIG. 2.

Figure 3:
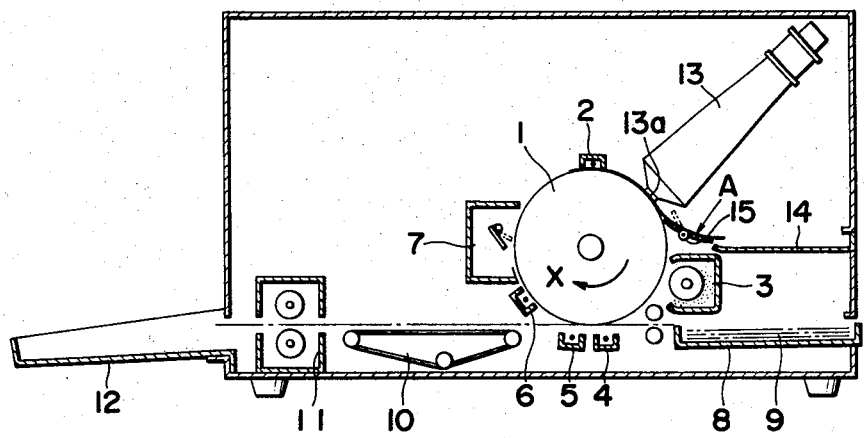
FIG. 3 is a sectional view showing an apparatus embodying a second embodiment of the present invention.

FIG. 3 shows a second embodiment of the present invention. The cleaning sheet A in this embodiment is supplied from the magazine 8 similarly to the first embodiment but is trapped by a tray 14 which is specially prepared. Just behind the reproducing means 13 in the rotational direction X of the photosensitive drum 1, more specifically, there is positioned a separation pawl 15 which is operated only in the cleaning mode so that the cleaning sheet A is separated from the photosensitive drum 1 by the action of the separation pawl 15 until it is discharged into the tray 14.

Figure 4:
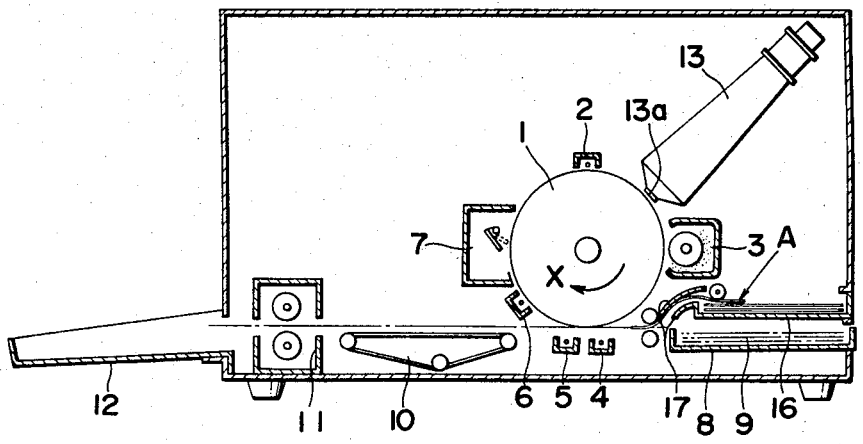
FIG. 4 is a sectional view showing an apparatus embodying a third embodiment of the present invention.

In the third embodiment of the present invention shown in FIG. 4, the cleaning sheet A is supplied to the photosensitive drum 1 through a guide member 17 from a magazine 16 which is positioned above the magazine 8 for accommodating the recording paper 9. Moreover, the cleaning sheet A in the third embodiment cleans the scanning surface 13*a* similarly to the case of the first embodiment and is then discharged into the tray 12 by the action of the conveyor 10.

Figure 5:
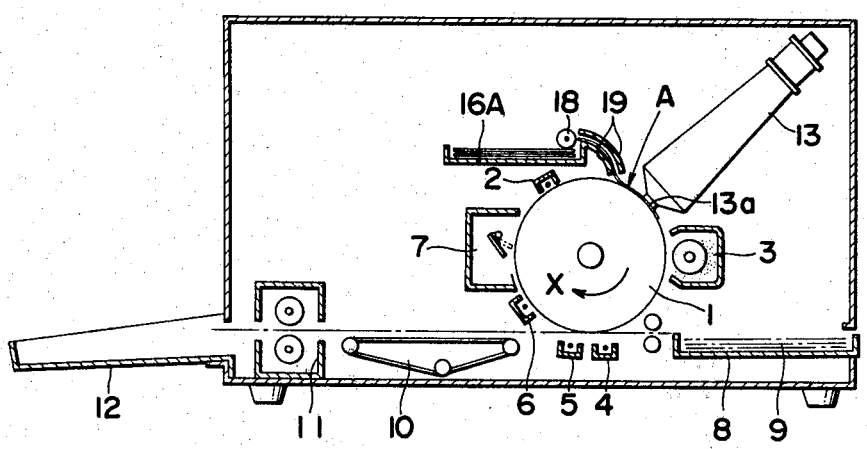
FIG. 5 is a sectional view showing an apparatus embodying a fourth embodiment of the present invention.

FIG. 5 shows an apparatus to which the fourth embodiment of the present invention is applied. In this fourth embodiment, there is provided a magazine 16A, which is disposed above the corona charger 2 so that the cleaning sheet A stored in that magazine 16A is supplied by the actions of a delivery roller 18 and a guide member 19 to a portion of the photosensitive drum 1 which is positioned just before the reproducing means 13 in the rotational direction X of the photosensitive drum 1. After the cleaning sheet A has cleaned the scanning surface 13*a*, it is peeled from the photosensitive drum 1 by the action of the separation electrode 5 until it is discharged into the tray 12 similarly to the first and third embodiments.

Figure 6:
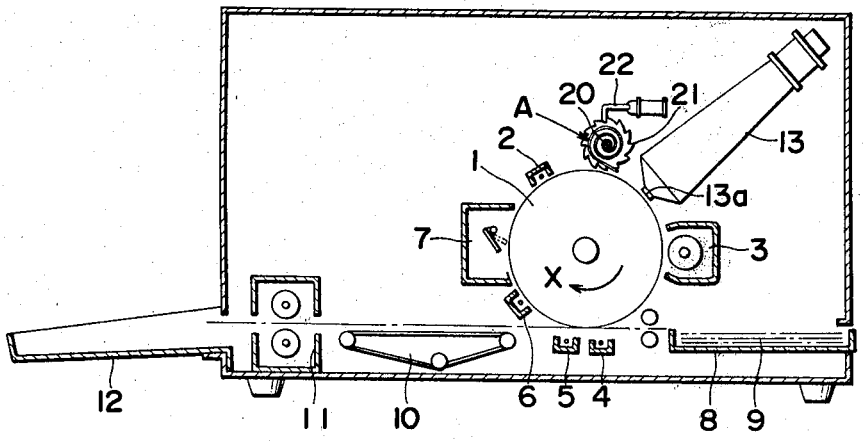
FIG. 6 is a sectional view showing an apparatus embodying a fifth embodiment of the present invention.

Moreover, FIG. 6 shows a fifth embodiment according to the present invention. The cleaning sheet A has its one end fixed to a spool 20, which is in parallel with the shaft of the photosensitive drum 1, so that it is taken up thereby. In the cleaning mode, a ratchet pawl 22 is released from the meshing engagement with a ratchet wheel 21 of the spool 20, and when the photosensitive drum 1 rotates the charger 2 operates to impart an attracting force to a section covering not the whole but one third of the circumference thereby, whereby, as the photosensitive drum 1 rotates, the cleaning sheet A electrically attracted thereby is let off so that the scanning surface 13*a* is cleaned. After the cleaning sheet A has been extracted, the photosensitive drum 1 is reversed, and the cleaning sheet A is taken up upon the spool 20 by the action of the ratchet pawl 22 which is in synchronism with the reverse rotation.

As has been described in detail hereinbefore, in the method according to the present invention, without any provision of fixing means such as a fixture or a protrusion at the side of the picture image forming member, the cleaning sheet can be made to pass through the narrow clearance between the picture image forming member and the scanning surface of the reproducing means without any resultant separation between the aforementioned picture image forming member and the cleaning sheet merely by making use of the strong electrostatic attracting force therebetween.

As is now apparent from the description thus far made, according to the present invention, the scanning surface of the reproducing means can be cleaned without any damage upon the surface of the photosensitive member with a slight change in the electrostatic recording apparatus merely by selectively operating the attachment device. Moreover, the scanning surface cleaning method according to the present invention can be widely applied not only to the printer type scanning reproducing system, which has been described as the embodiments, but also to a complex information recording apparatus having both the copying function and the recording function resorting to the reproducing means. Thus, the construction of the apparatus can be made simple and inexpensive.

What is claimed is:

1. In an electrostatic information recording apparatus comprising reproducing means for scanning and reproducing an electric information signal as an electrostatic latent image upon a picture image forming member, and means including a plurality of devices operable for developing the electrostatic latent image upon said picture image forming member with toner thereby to produce a visualized record, a method of cleaning the scanning surface of said reproducing means comprising the steps of: rendering inoperative at least some of the devices of the developing means, which means is used to treat the picture image forming member, when the cleaning operation is necessary; and electrostatically attaching a flexible cleaning sheet to the picture image forming member so that the cleaning sheet is carried past the scanning surface of the reproducing means thereby to clean the scanning surface.

2. A method as set forth in claim 1, wherein the cleaning sheet is supplied from a recording paper supply magazine.

3. A method as set forth in claim 1 or 2, wherein the cleaning sheet having passed the scanning surface of the reproducing means is discharged into a tray by means of a separating pawl which is operated only in a cleaning mode.

4. A method as set forth in claim 1, wherein said cleaning sheet is supplied from a magazine which is disposed above a recording paper supply magazine.

5. A method as set forth in claim, 1 wherein the cleaning sheet is supplied from a magazine which is disposed above a corona charger.

6. A method as set forth in claim 1, wherein the cleaning sheet is taken up upon a spool which is in parallel with the shaft of the picture image forming member, wherein a charger charges part of the circumference of the member when in a cleaning mode so that the cleaning sheet is extracted past the scanning surface of the reproducing means thereby to effect the cleaning operation, and wherein the member is then reversed to take up the cleaning sheet upon the spool.

7. A method of cleaning the scanning surface of a reproducing means used in electrostatic information recording apparatus for scanning and reproducing an electric information signal as an electrostatic latent image upon a picture image forming member spaced from said scanning surface comprising the steps of:

electrostatically charging said picture image forming member;

electrostatically attaching a flexible cleaning sheet to said member;

and moving said member with said sheet attached thereto relative to said scanning surface whereby said sheet wipes said scanning surface.

8. A method according to claim 7 further including the step of separating said sheet from said member after said sheet wipes said scanning surface.

9. A method according to claim 8 wherein said step of separating said sheet from said member is effected by removing the electrostatic charge attaching said sheet to said member.

10. A method according to claim 8 wherein said step of separating said sheet from said member is effected by mechanically removing said sheet from said member.

* * * * *